US005501817A

United States Patent [19]

Kischkel et al.

[11] Patent Number: 5,501,817

[45] Date of Patent: Mar. 26, 1996

[54] PROCESS FOR STABILIZING AQUEOUS ZEOLITE SUSPENSIONS USING A LINEAR FATTY ALCOHOL POLYGLYCOL ETHER HAVING A SPECIFIC DEGREE OF ETHOXYLATION

[75] Inventors: Ditmar Kischkel, Monheim; Karl Schmid, Mettmann; Andreas Syldath; Thomas Krohnen, both of Duesseldorf, all of Germany

[73] Assignee: Henkel Kommanditgesellschaft auf Aktien, Duesseldorf, Germany

[21] Appl. No.: 284,594

[22] PCT Filed: Feb. 1, 1993

[86] PCT No.: PCT/EP93/00227

§ 371 Date: Aug. 10, 1994

§ 102(e) Date: Aug. 10, 1994

[87] PCT Pub. No.: WO93/16159

PCT Pub. Date: Aug. 19, 1993

[30] Foreign Application Priority Data

Feb. 10, 1992 [DE] Germany ..... 42 03 789.1

[51] Int. Cl.[6] ..... C11D 3/12; C11D 1/72

[52] U.S. Cl. ..... 252/174.25; 252/173; 252/174.21; 252/DIG. 1; 252/DIG. 14

[58] Field of Search ..... 252/174.25, 174.21, 252/174.22, DIG. 1, DIG. 14, 173

[56] References Cited

U.S. PATENT DOCUMENTS

| | | | |
|---|---|---|---|
| 4,072,622 | 2/1978 | Kühling et al. | 252/174.25 |
| 4,083,793 | 4/1978 | Jakobi et al. | 252/174.25 |
| 4,169,075 | 9/1979 | Kuhling et al. | 252/558 |
| 4,179,393 | 12/1979 | Andree et al. | 252/174.25 |
| 4,264,480 | 4/1981 | Andree et al. | 252/174.25 |
| 4,280,920 | 7/1981 | Garvey et al. | 252/174.25 |
| 4,405,483 | 9/1983 | Kuzel et al. | 252/174.25 |
| 4,483,012 | 3/1984 | Kühling et al. | 252/174.25 |
| 4,529,541 | 7/1985 | Wilms et al. | 252/174.25 |
| 4,668,420 | 5/1987 | Diehl et al. | 252/174.25 |
| 4,671,887 | 6/1987 | Diehl et al. | 252/174.25 |
| 5,174,918 | 12/1992 | Diehl et al. | 252/174.25 |
| 5,252,244 | 10/1993 | Beaujean et al. | 252/174.25 |
| 5,298,185 | 3/1994 | Leonhardt et al. | 252/174.25 |
| 5,312,793 | 5/1994 | Colombo et al. | 252/174.15 |
| 5,354,493 | 10/1994 | Wilms | 252/174.25 |

FOREIGN PATENT DOCUMENTS

| | | |
|---|---|---|
| 0294574 | 12/1988 | European Pat. Off. . |
| 2527388 | 4/1976 | Germany . |
| 3330220 | 3/1985 | Germany . |
| 3408040 | 9/1985 | Germany . |
| 3423351 | 1/1986 | Germany . |
| 3401861 | 3/1986 | Germany . |
| 3444311 | 6/1986 | Germany . |
| 3719042 | 6/1987 | Germany . |
| 4124247 | 1/1993 | Germany . |
| 57-61616 | 4/1982 | Japan . |
| 57-61615 | 4/1982 | Japan . |
| 2015488 | 9/1979 | United Kingdom . |

OTHER PUBLICATIONS

Chem.i.u.Zt., 20, 117 (1986).
Tens. Surf. Det., 24, 322 (1987).

*Primary Examiner*—Paul Lieberman
*Assistant Examiner*—Ardith Hertzog
*Attorney, Agent, or Firm*—Wayne C. Jaeschke; Norvell E. Wisdom, Jr.; Daniel S. Ortiz

[57] ABSTRACT

A method for stabilizing aqueous zeolite suspensions by adding fatty-alcohol poly(ethylene glycol) ethers of the formula $R^1O—(CH_2CH_2O)_n$ in which $R^1$ is a linear aliphatic alkyl group containing 12 to 14 carbon atoms and n is an average number of from 4.2 to 4.8. Aqueous slurries containing from 20 to 60% by weight of zeolite are stabilized by adding it to the slurry from 0.1 to 5% by weight of the fatty-alcohol poly(ethylene glycol) ethers.

4 Claims, No Drawings

PROCESS FOR STABILIZING AQUEOUS ZEOLITE SUSPENSIONS USING A LINEAR FATTY ALCOHOL POLYGLYCOL ETHER HAVING A SPECIFIC DEGREE OF ETHOXYLATION

FIELD OF THE INVENTION

This invention relates to a process for stabilizing aqueous zeolite suspensions by addition of selected fatty alcohol polyethylene glycol ethers.

PRIOR ART

Zeolites, more particularly those of the zeolite A type, have particular significance as builders in modern detergents and have largely displaced the polyphosphates used for decades. Their advantages lie not only in a high calcium binding capacity, but also and above all in their high ecotoxicological compatibility [Tens. Surf. Det., 24, 322 (1987)].

In their production, zeolites are obtained in the form of aqueous suspensions which may either be stored and marketed as such or subjected to spray drying. Zeolites show extremely low solubility in water so that zeolite suspensions readily sediment. In the most favorable case, this leads to phase separation although, normally, considerable quantities of the solid sink to the bottom of the vessels in storage, solidify and have to be removed, size-reduced and resuspended with considerable effort. In other cases, the suspension undergoes such a drastic increase in viscosity that transfer to other vessels or circulation by pumping becomes difficult, if not impossible, and always involves considerable product losses.

There has been no shortage of attempts in the past to stabilize aqueous zeolite suspensions in such a way that they remain stable in storage for a sufficient time and can be transported through pipelines without blocking them.

For example, it is proposed in German patent application DE 33 30 220 A1 to add 0.5 to 5% by weight of a mixture of fatty alcohol ethoxylates and fatty alcohol sulfates or fatty alcohol ether sulfates to the suspensions.

German patent application DE 34 08 040 A1 describes a process for stabilizing 65% by weight zeolite A suspensions with 0.01 to 0.25% by weight of xanthan gum and carboxyl- or hydroxyl-containing polymers.

According to the teaching of German patent application DE 34 23 351 A1, zeolite suspensions can also be stabilized by addition of polyglycol ethers, fatty alcohol ether sulfates, fatty acid alkanolamides or fatty acid monoglycerides at pH 9 to 10.

In addition, the use of many other stabilizers, for example polycarboxylates having molecular weights above 1,500, phosphonic acids, phosphoric acid esters, alkyl benzenesulfonates, layer silicates [DE-OS 25 27 388], alkylphenol polyglycol ethers [DE 34 01 861 A1], isotridecyl polyglycol ethers [DE 34 44 311 A1] and adducts of ethylene oxide with oxoalcohols [DE 37 19 042 A1], is known from the literature.

Unfortunately, known processes have disadvantages in regard to adequate stabilization over a relatively wide temperature range, in regard to the necessary quantities of stabilizer and also in regard to the viscosity and residue-free pouring behavior of the suspensions.

Accordingly, the problem addressed by the present invention was to provide an improved process for stabilizing aqueous zeolite suspensions which would be free from the described disadvantages.

DESCRIPTION OF THE INVENTION

The present invention relates to a process for stabilizing aqueous zeolite suspensions by addition of surfactants, characterized in that fatty alcohol polyethylene glycol ethers corresponding to formula (I):

$$R^1O—(CH_2CH_2O)_nH \quad (I)$$

in which $R^1$ is an aliphatic alkyl or alkenyl radical containing 12 to 18 carbon atoms and n is a number of 4 to 7, are added to the suspensions.

It has surprisingly been found that the use of the selected fatty alcohol polyethylene glycol ethers mentioned or mixtures thereof with one another can reliably stabilize suspensions of zeolites over a broad temperature range, more particularly from 10° to 60° C. The suspensions also show high stability in storage over prolonged periods, can be pumped through pipelines and can be readily poured out with only minimal product losses.

In the context of the invention, zeolites are optionally water-containing alkali metal or alkaline earth metal alumosilicates corresponding to general formula (V):

$$M_{2/z}O \,.\, Al_2O_3 \,.\, x\, SiO_2 \,.\, y\, H_2O \quad (V)$$

in which M is an alkali metal or alkaline earth metal with a valency of z, x is a number of 1.8 to 12 and y is a number of 0 to 8 [Chem. i. u. Zt., 20, 117 (1986)].

Typical examples of zeolites of which aqueous dispersions may be stabilized by the process according to the invention are the naturally occurring minerals clinoptilolite, erionite or chabasite. However, synthetic zeolites, for example zeolite X $Na_{86}[(AlO_2)_{86}(SiO_2)_{106}] \,.\, 264\, H_2O$ zeolite Y $Na_{56}[(AlO_2)_{56}(SiO_2)_{136}] \,.\, 325\, H_2O$ zeolite L $K_9[AlO_2)_9SiO_2)_{27}] \,.\, 22\, H_2O$ mordenite $Na_{8.7}[AlO_2)_{8.7}(SiO_2)_{39.3}] \,.\, 24\, H_2O$ are preferred, zeolite A $Na_{12}[(AlO_2)_{12}(SiO_2)_{12}] \,.\, 27\, H_2O$ being particularly preferred.

The aqueous suspensions may contain the zeolites in quantities of 20 to 60% by weight and preferably in quantities of 25 to 50% by weight.

Fatty alcohol polyethylene glycol ethers are known nonionic surfactants which may be produced on an industrial scale by the ethoxylation process known per se.

Stabilizers suitable for the process according to the invention are adducts of on average 4 to 7 moles of ethylene oxide with technical fatty alcohols containing 12 to 18 carbon atoms and 0 or 1 double bond. Typical examples are ethylene oxide adducts with lauryl alcohol, myristyl alcohol, cetyl alcohol, palmitoleyl alcohol, stearyl alcohol, oleyl alcohol, elaidyl alcohol, petroselinyl alcohol, arachidyl alcohol, gadoleyl alcohol, behenyl alcohol and erucyl alcohol.

Fatty alcohol polyglycol ethers corresponding to formula (I), in which $R^1$ is an alkyl radical containing 12 to 18 and more particularly 12 to 14 carbon atoms and n is a number of 4 to 5 and more particularly a number of 4.2 to 4.8, are preferred. The fatty alcohol polyethylene glycol ethers may have a conventional homolog distribution and also a narrowrange homolog distribution as obtained, for example, when the ethoxylation of the fatty alcohols is carried out in the presence of hydrotalcite catalysts.

In addition, fatty alcohol polyethylene glycol ethers which are not derived from the pure alcohols, but instead from the technical cuts obtained for example in the selective hydrogenation of fatty acid methyl ester fractions based on vegetable or animal raw materials may also be used. Fatty alcohol polyethylene glycol ethers based on coconut oil fatty alcohols are preferably used. An adduct of on average 4.4 moles of ethylene oxide with a technical $C_{12/14}$ fatty alcohol and an adduct of on average 5 to 7 moles of ethylene oxide with a technical $C_{12/18}$ fatty alcohol having an iodine value of 5 to 95 and preferably 10 to 55 are particularly preferred.

The fatty alcohol polyethylene glycol ethers may be used individually or even in the form of mixtures with one another. More particularly, it is even possible to use mixtures of fatty alcohol polyethylene glycol ethers having a relatively high and/or relatively low average degree of ethoxylation providing the average degree of ethoxylation of the resulting mixture lies within the range according to the invention of 4 to 5.

The introduction of the fatty alcohol polyethylene glycol ethers into the suspension is not critical and may be carried out, for example, mechanically by stirring, optionally at elevated temperatures of 50° C. No chemical reaction takes place. The stabilizers may be added to the suspensions in quantities of 0.1 to 5% by weight and preferably in quantities of 1 to 3% by weight, based on the suspension.

Industrial Applications

The zeolite suspensions obtainable by the process according to the invention are thermally stable and stable in storage. They are suitable, for example, for the production of detergent concentrates.

The following Examples are intended to illustrate the invention without limiting is in any way.

EXAMPLES

I. Stabilizers used

A1 Adduct of on average 4.4 moles of ethylene oxide (EO) with a $C_{12-14}$ fatty alcohol.

A2 Mixture of two $C_{12/14}$ fatty alcohol ethoxylates: 53.8% by weight adduct of on average 4.1 moles of EO 46.2% by weight adduct of on average 4.75 moles of EO average degree of ethoxylation: 4.4

A3 Mixture of two $C_{12/14}$ fatty alcohol ethoxylates: 53.3% by weight adduct of on average 3.7 moles EO 46.7% by weight adduct of on average 5.2 moles EO average degree of ethoxylation: 4.4

B1 Adduct of on average 6.5 moles of ethylene oxide (EO) with isotridecyl alcohol.

B2 Adduct of on average 5.2 moles of ethylene oxide (EO) with $C_{12-14}$ coconut oil fatty alcohol (iodine value <2).

B3 Adduct of on average 3.7 moles of ethylene oxide (EO) with $C_{12-14}$ coconut oil fatty alcohol (iodine value <2).

Stabilizers A1 to A3 correspond to the invention while stabilizers B1 to B3 are comparison stabilizers.

II. Test procedure

An aqueous suspension of zeolite A (Sasil®, solids content: 49.6% by weight, free alkali content: 0.32% by weight, a product of Henkel KGaA, Düsseldorf, FRG) was introduced into a 500 ml glass beaker and quantities of 1.5% by weight, based on the suspension, of the stabilizers or stabilizer mixtures (expressed as solids) were then added.

The stability of the suspensions was measured over a period of 1 to 6 days at a temperature T of 20° to 50° C. The Brookfield viscosity and sedimentation behavior were determined using the following scale:

1=slight sediment, no solidification
2=slight sediment, slight solidification
3=slight sediment, pronounced solidification
4=distinct sediment, no solidification
5=distinct sediment, slight solidification
6=distinct sediment, pronounced solidification
7=thick sediment, no solidification
8=thick sediment, slight solidification
9=thick sediment, pronounced solidification The test results are set out in Table 1.

TABLE 1

Sedimentation of zeolite suspensions

| | | T | Viscosity (mPa · s) | | Sedimentation | |
|---|---|---|---|---|---|---|
| Ex. | Stab. | °C. | 1d | 6d | 1d | 6d |
| 1 | A1 | 20 | 2,000 | 2,000 | 1 | 1 |
| 2 | A1 | 50 | 2,000 | 2,000 | 1 | 2 |
| 3 | A2 | 20 | 2,000 | 2,000 | 1 | 2 |
| 4 | A2 | 50 | 2,000 | 2,000 | 1 | 1 |
| 5 | A3 | 20 | 2,000 | 2,000 | 1 | 1 |
| 6 | A3 | 50 | 2,000 | 2,000 | 2 | 4 |
| C1 | B1 | 20 | 40,000 | 40,000 | 1 | 2 |
| C2 | B2 | 20 | 40,000 | 40,000 | 8 | 8 |
| C3 | B3 | 20 | 2,000 | 2,000 | 1 | 1 |
| C4 | B3 | 50 | 2,000 | 40,000 | 3 | 8 |

We claim:

1. A process for stabilizing an aqueous zeolite suspension, which comprises: adding to the suspension comprising from 20% to 60% by weight of zeolite, from 0.1 to 5% by weight of the suspension of a suspending agent consisting essentially of at least one fatty alcohol polyethylene glycol ether of the formula: $R^1O—(CH_2CH_2O)_n$ wherein $R^1$ consists essentially of a linear aliphatic alkyl group containing 12–14 carbon atoms and n is an average number of 4.2 to 4.8 for the total amount of fatty alcohol polyethylene glycol ether suspending agent.

2. The process of claim 1, wherein the fatty alcohol polyethylene glycol ether is added to an aqueous suspension of zeolite A.

3. The process of claim 1, wherein from 1% to 3% by weight, based on the weight of the suspension, of the fatty alcohol polyethylene glycol ether is added to the suspension.

4. The process of claim 2, wherein from 1% to 3% by weight, based on the weight of the suspension, of the fatty alcohol polyethylene glycol ether is added to the suspension.

* * * * *